US005765482A

United States Patent [19]

Wittkopf et al.

[11] Patent Number: 5,765,482

[45] Date of Patent: Jun. 16, 1998

[54] WEB PRINTING APPARATUS

[75] Inventors: Eugene W. Wittkopf, Suamico; Gregory D. Leanna, Oneida, both of Wis.

[73] Assignee: Integrated Design Corporation, Green Bay, Wis.

[21] Appl. No.: 724,789

[22] Filed: Oct. 2, 1996

[51] Int. Cl.[6] ..... B41F 13/004

[52] U.S. Cl. ..... 101/228; 101/219

[58] Field of Search ..... 101/228, 219

[56] References Cited

U.S. PATENT DOCUMENTS

| | | | |
|---|---|---|---|
| 2,906,143 | 9/1959 | Musser | 74/640 |
| 3,724,733 | 4/1973 | Schaffer et al. | 226/25 |
| 4,361,089 | 11/1982 | Wittkopf et al. | 101/247 |
| 4,362,098 | 12/1982 | Stelling et al. | 101/219 |
| 4,363,270 | 12/1982 | Ury et al. | 101/181 |
| 4,785,734 | 11/1988 | Kawana et al. | 101/181 |
| 4,817,457 | 4/1989 | Carlson | 74/640 |
| 4,817,525 | 4/1989 | Yagi | 101/219 |
| 4,934,212 | 6/1990 | Hofmeister | 74/640 |
| 4,945,293 | 7/1990 | Wittkopf et al. | 318/7 |
| 5,265,527 | 11/1993 | Tedford | 101/148 |
| 5,570,633 | 11/1996 | Schultz et al. | 101/182 |

*Primary Examiner*—Edgar S. Burr
*Assistant Examiner*—Daniel J. Colilla
*Attorney, Agent, or Firm*—Senniger, Powers, Leavitt & Roedel

[57] ABSTRACT

Web printing apparatus having an impression roll and method of operating the apparatus for printing webs having different characteristics, such as different thickness and/or different modulus of elasticity, in which the speed of the impression roll is adjusted in accordance with the said characteristics and the tension to which the web is subjected in the printing operation to feed forward webs of different characteristics at different speeds for precision in impression length.

1 Claim, 5 Drawing Sheets

WEB PRINTING APPARATUS

BRIEF SUMMARY OF THE INVENTION

This invention relates to web printing apparatus and more particularly to a flexographic printing press for continuous feed of webs of material, particularly paper webs, for flexographic printing on the webs.

The flexographic printing press of this invention is especially adapted for printing on webs of different thickness and/or different modulus of elasticity. It includes an impression roll and a plate roll, the web to be printed travelling between these rolls for printing of impressions on the web by the plate roll, the web travelling around the impression roll, the impression roll being rotary in one direction to feed the web forward at a rate of speed (the linear velocity of the web) related to the roll diameter and the roll speed i.e. the revolutions per minute (RPM) of the roll. Heretofore, use of such a flexographic press for printing on webs of different thickness and/or different modulus of elasticity has presented problems in situations where it is desired that the impressions printed on the different webs are of the same length, the difficulty being that the impressions on the different webs after the printing operation and relief of tension on the webs come out to be of different length. Accordingly, among the several objects of the invention may be noted the provision of a flexographic printing press for printing webs of different thickness and/or different modulus of elasticity with the impressions printed on the different webs being of substantially the same length when the printed webs are relieved of tension; and the provision of apparatus operable for this purpose with high accuracy.

In general, a flexographic printing press of this invention has an impression roll and a plate roll, wherein a web to be printed travels between said rolls for printing of impressions on the web by the plate roll, the web travelling around the impression roll, and the impression roll being rotary in one direction to feed the web forward at a rate of speed related to the impression roll diameter and the impression roll speed, and comprises means for driving the impression roll including means for adjusting the speed of the impression roll for feeding webs of different thickness and/or different modulus of elasticity forward one at a time with the web under tension and with the speed of the impression roll adjusted in accordance with the thickness and/or modulus of elasticity and the tension on the web being fed forward to feed webs of different thickness and/or modulus of elasticity at different speeds such that the impressions printed on the different webs are of substantially the same length when the printed webs are relieved of tension.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
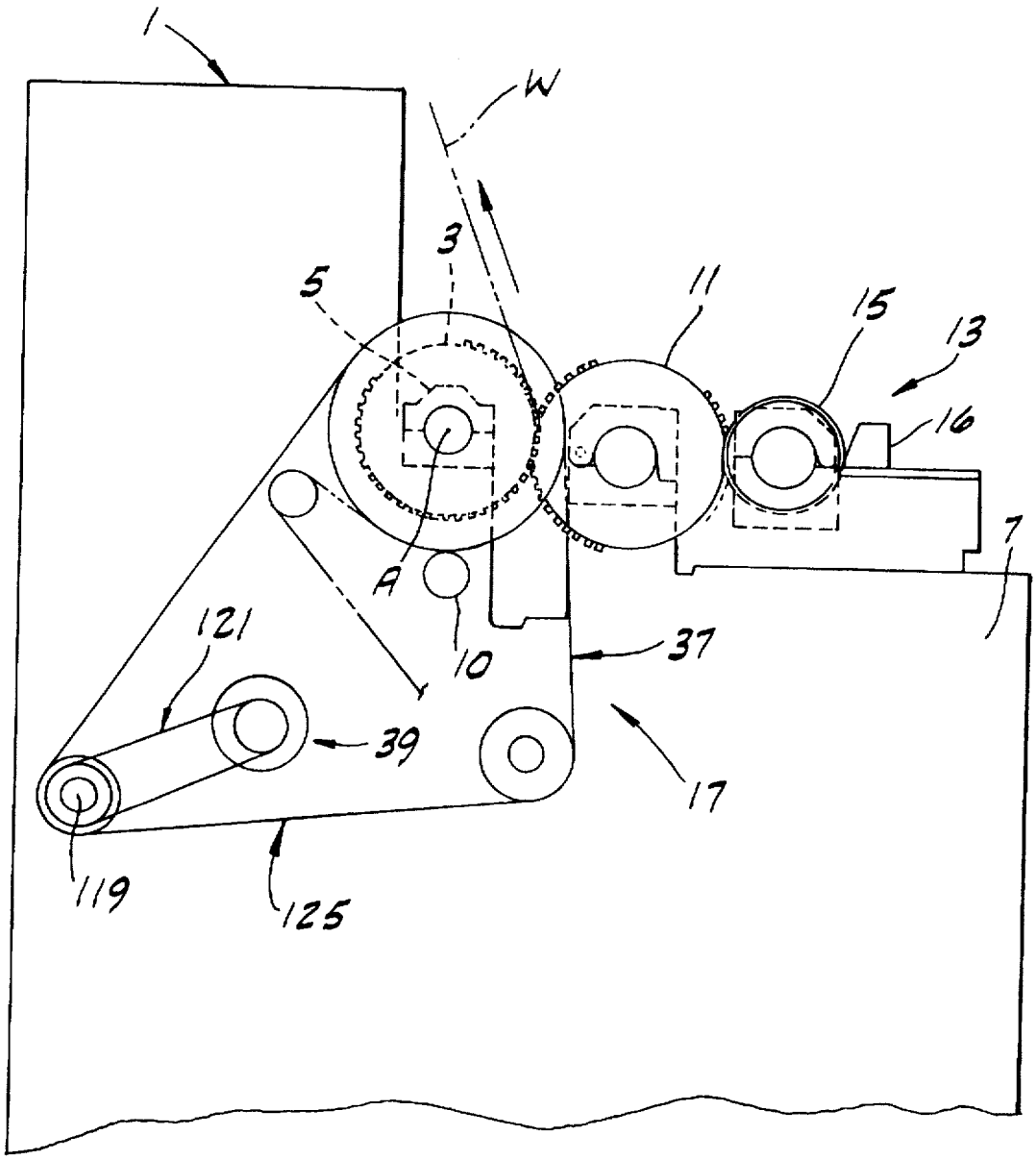
FIG. 1 is a semi-diagrammatic view in elevation of a web printing apparatus (a flexographic printing press) of the invention as viewed from one side of the press, the opposite side being generally a mirror image thereof.

Referring to the drawings, a flexographic printing apparatus of this invention is shown to comprise a frame generally designated 1 and an impression roll 3 journalled at its ends as generally indicated at 5 in spaced-apart vertical side frame members 7 and 9 extending transversely of the apparatus. Member 7 appear generally in its entirety in FIG. 1. Member 7 and member 9 appear fragmentarily in FIG. 2. At 10 is indicated a nip roll which engages the web travelling around the impression roll. At 11 is generally indicated a plate roll rotary on an axis parallel to the axis A of the impression roll adapted for mounting thereon of a printing plate or plates (not shown), more particularly a flexographic printing plate or plates, cooperable with the impression roll for engagement of the printing plate or plates with a web W travelling around the impression roll in the direction indicated by the arrow in FIG. 1. The web travels through the apparatus under tension imposed as usual in the art. At 13 is generally indicated means for applying ink to the printing plate or plates on the plate roll 11. This means may conventionally comprise an anilox roll 15 engageable with the plate or plates on the plate roll and an applicator 16 such as a fountainless applicator of well-known commercially available type. As well known in the art, the plate roll may be movable toward and away from the impression roll and the anilox roll and applicator may be movable toward and away from the plate roll, the details providing for such movement not being critical insofar as this invention is concerned.

Figure 3:
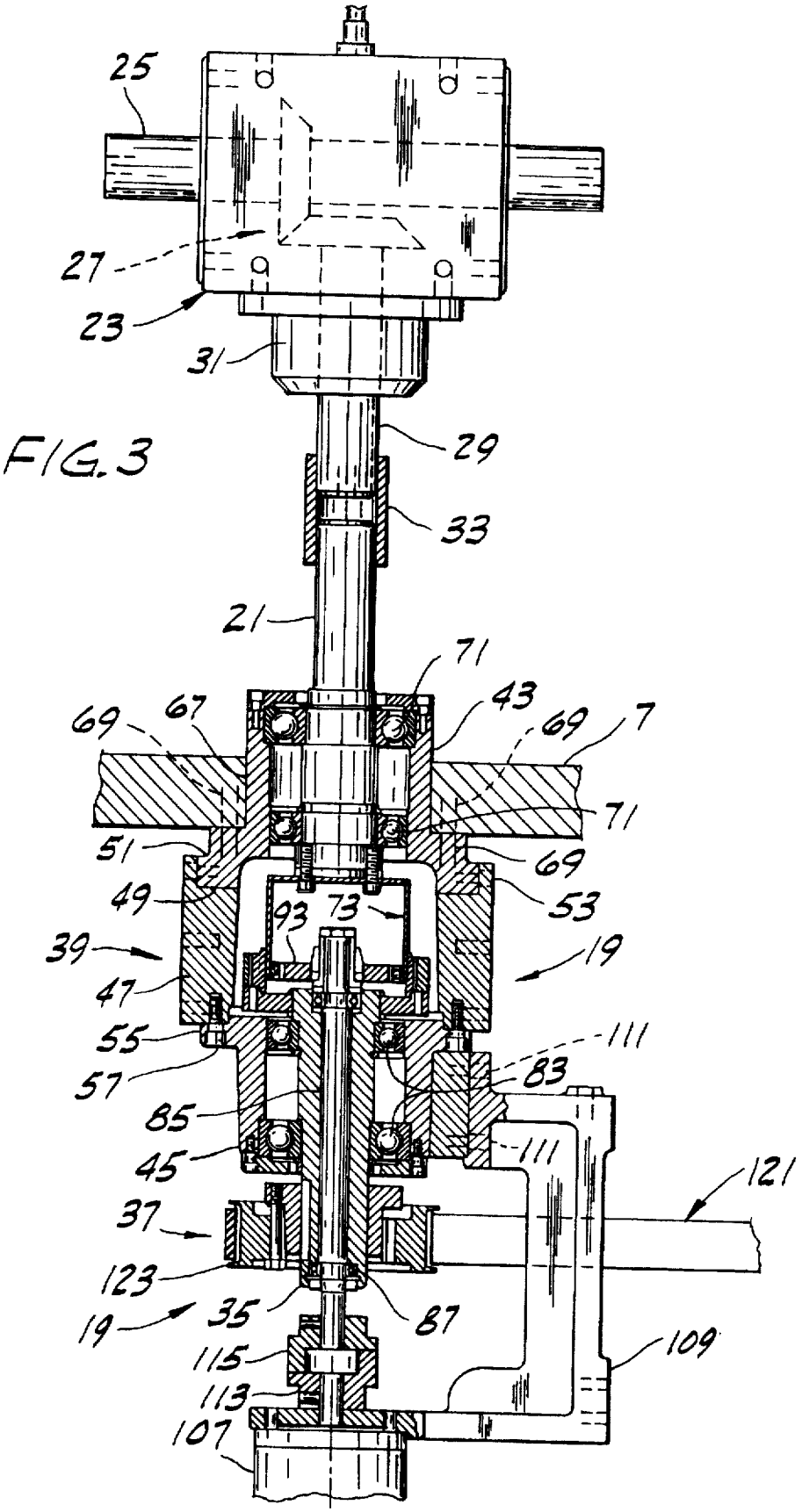
FIG. 3 is a view in section on a larger scale than FIG. 2 of part of the drive for the impression roll.

At 17 is generally indicated means for driving the impression roll in the direction to feed the web forward at a rate of speed (the linear velocity of the web) related to the diameter of the impression roll and the speed of the impression roll, this drive means including in accordance with this invention means indicated in its entirety at 19 for accurately adjusting the speed of the impression roll in accordance with the thickness and/or modulus of elasticity and the tension of the web being fed forward, for feeding forward webs of different thickness and/or modulus of elasticity at different speeds such that the impressions printed on the different webs are of substantially the same length when the printed webs are relieved of tension. As herein illustrated, the flexographic web printing apparatus or flexographic printing press of this invention is one of a series of presses stationed in tandem for multi-color printing, and comprises a shaft 21 constituting the input shaft of the adjustable speed drive means 19 driven at a constant speed via a take-off drive 23 from a line shaft 25, the latter serving all the presses in the series. The take-off drive 23 comprises bevel gearing as indicated at 27 (see FIG. 3) providing a right-angle drive from the line shaft to the output shaft 29 of the drive 23 which is journalled in a bearing indicated at 31 of the take-off drive for rotation on an axis parallel to the impression roll axis A. Shaft 29 is driven at the same speed as the line shaft 23 (e.g. 2000 RPM) and is coaxially connected to the stated input shaft 21 of the adjustable speed means 19 (or variable speed drive mechanism 19) by means of a coupling such as indicated at 33. Means 19 has an output shaft 35 adapted to be driven at different speeds from the input shaft connected by a drive train generally indicated at 37 to the impression roll 3.

Figure 4:
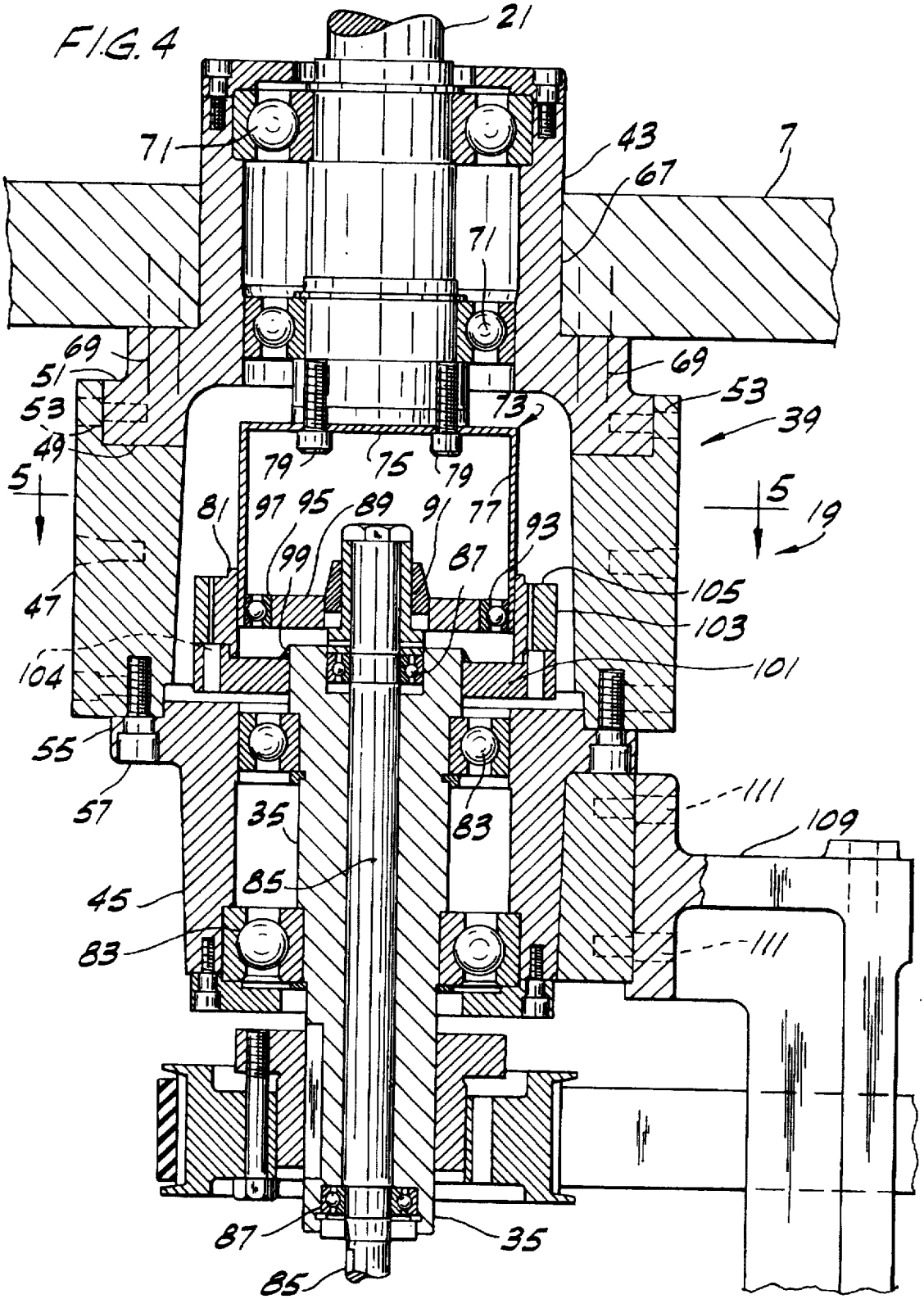
FIG. 4 is an enlarged fragment of FIG. 3.
Figure 5:
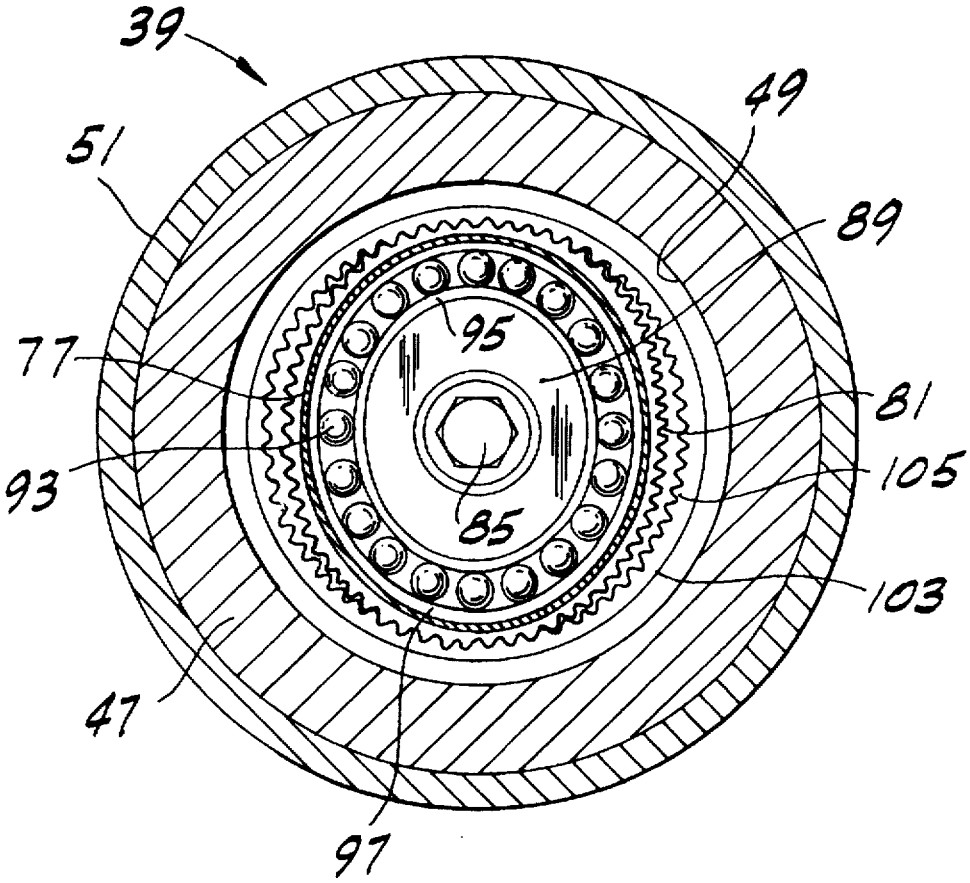
FIG. 5 is a view in transverse section on line 5—5 of FIG. 4.

The adjustable speed means or variable speed drive mechanism 19 is preferably a strain wave gear device and more particularly a device such as a Harmonic Drive (or Harmonic Drive gearing) sold by Harmonic Drive Division, Emhart Machinery Group, of Wakefield, Mass., described in detail in C. Walton Musser U.S. Pat. No. 2,906,143 issued Sep. 29, 1959 and in the coassigned Eugene W. Wittkopf and Glen B. Leanna U.S. Pat. No. 4,945,293 issued Jul. 31, 1990. As illustrated in detail in FIGS. 3 and 4, it comprises a housing generally designated 39 having tubular end extensions 43 and 45. Extension 43 is referred to as the input end extension and extension 45 is referred to as the output end extension of the strain wave gear device. In detail, the housing 39 comprises a hollow generally cylindric body 47 having an annular recess 49 at one end constituting its outer end. Extension 43 has a head 51 at one end constituting its outer end (on the inside of side frame member 7) received in the recess 49, the body being secured on the head 51 as indicated at 53. The extension 43 and the body 47 may be made integral. Extension 45 has a head 55 at one end thereof constituting its outer end secured as indicated at 57 to the other end (the inner end) of the body 47.

The housing 39 is mounted coaxially with the output shaft 29 of the take-off drive 23 on the inside of the side frame member 7 with the head 51 of extension 43 engaging the inside of said side frame member and with extension 43 extending out through an opening 67 in said side frame member, head 51 being fastened in place on the side frame member 7 as by screws indicated at 69. The input shaft 21 of the strain wave gear device 19 is journalled in bearings 71 in the input end extension 43 of the strain wave gear device housing 39 coaxially with the output shaft 29 of the take-off drive 23 and extends into the housing 39.

At 73 is indicated the cup-shaped strain gear or "flexspline" of the strain wave gear device, constituted by a thin-walled cup-shaped body made of a material which is elastic under the conditions of operation, e.g. steel of such thin cross-section that the end of the body of the strain gear may be easily deflected in a radial direction. The strain gear 73 has a circular base 75 and a cylindric peripheral wall 77, having its base 75 affixed to the inner end of shaft 21 within the housing 39 at the end of the central section of the housing toward extension 43 by screws 79, with the wall 77 extending toward the other end of the housing (the end toward extension 45). The strain gear 73 has an array of gear teeth indicated at 81 on the exterior of its cylindrical peripheral wall 77 at the open end of the strain gear adjacent the end of the housing 39 toward extension 45. The output shaft 35 of the strain wave gear device is a tubular shaft journalled in bearings 83 in the housing extension 45 coaxially with the input shaft 21 (and with the strain gear). A shaft 85, which may be referred to as the strain wave generator shaft, extends lengthwise within the output shaft 35, being journalled in bearings 87 in shaft 35. Shaft 85 extends inward from the inner end of shaft 35 and has an elliptical cam 89 affixed on its inner end as indicated at 91, this cam also being referred to as the strain inducer or wave generator of the strain wave gear device. The cam or wave generator is rotary within a ball race 93 having inner and outer flexible rings 95 and 97, the cam and the ball race being in the plane of the series of the external gear teeth 81 of the strain gear 73, the outer flexible ring 97 engaging the inside of the peripheral wall 77 of the strain gear at the open end of the cup-shaped strain gear body.

Fixed as indicated at 99 on the inner end of the output shaft 35 within the housing 39 is a rotor 101 having a ring gear 103, also termed a circular spline, fastened as indicated at 104 on its inside face. The ring gear has an annular series of internal teeth 105 in mesh with the external gear teeth 81 of the strain gear 73. With the cam 89 being a two-lobe cam, the number of external teeth 81 on the strain gear 73 is two less than the number of internal gear teeth 105 of the ring gear 103 (e.g. two hundred teeth 81 and two hundred two teeth 105).

A motor 107 mounted outboard of the housing extension 45 on a bracket 109 secured as indicated at 111 to the coaxial housing extension 45 has its shaft 113 coaxial with and coupled as indicated at 115 to the strain wave generator shaft 85 for driving the cam 89 (the strain inducer or wave generator) at different speeds in the same direction as that of the strain gear or "flexspline".

Figure 2:
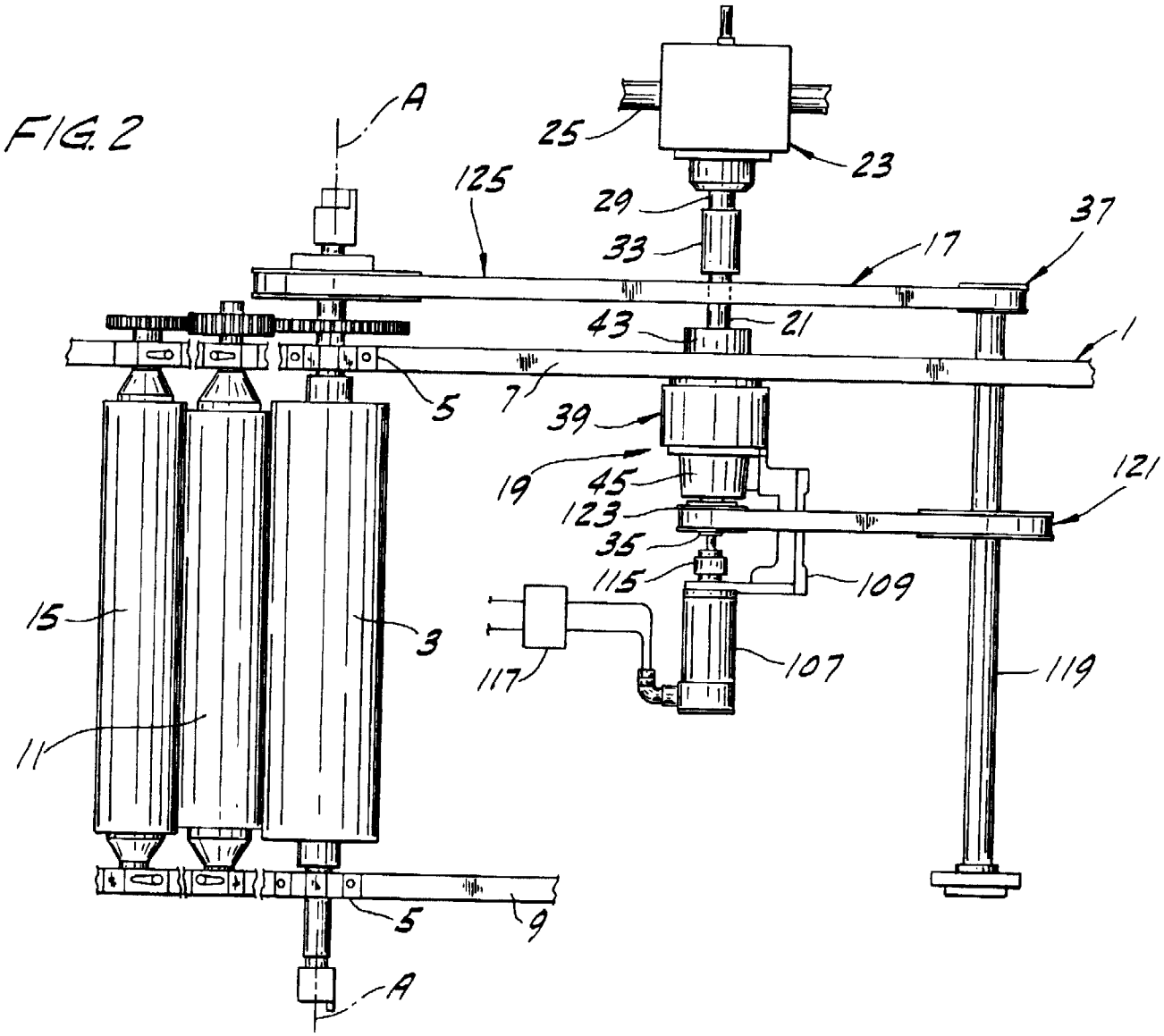
FIG. 2 is a semi-diagrammatic plan view of the apparatus with parts omitted showing the impression roll of the apparatus and the drive therefor, this view being in the nature of a developed view spread out with respect to FIG. 1.

The speed (RPM) of the output shaft 35 of the strain wave gear device is determined by the speed (RPM) of the input shaft 21 of the said device (herein noted as the same speed as that of the line shaft 25) and the speed (RPM) of the cam 89 (the strain inducer or wave generator) on shaft 85, adapted to be driven at different speeds by the motor 107. Thus, the speed (RPM) of the output shaft 35 may be adjusted (and with high accuracy) by adjusting the speed of the motor 107. The motor 107 is shown in FIG. 2 as controlled by a programmable controller 117 for adjusting its speed in accordance with pre-established data based on the diameter of the impression roll, characteristics of webs to be handled including web thickness and/or web modulus of elasticity, and the tension to which the web is subjected in the printing operation, for driving the impression roll at such speed that the impressions printed on the different webs are of substantially the same length when the printed webs are relieved of tension. Thus, for a given impression roll diameter and for a given speed of the input shaft 21, the motor 107 is driven at such a speed as to effect rotation of the output shaft 35 of the strain wave gear device at such a speed as to drive the impression roll via the drive train 37 at the proper speed. The drive train 37 is shown as comprising a jackshaft 119 driven by a toothed belt and pulley drive 121 from the output shaft 35 of the strain wave device, including a toothed pulley 123 on the shaft 35, and a toothed belt and pulley drive 125 from the jackshaft to the impression roll.

By way of example, with a web printing apparatus 1 of this invention having an impression roll (3) 9.5493 inches in diameter and a strain wave gear device having a flexspline 73 with 200 teeth and a ring gear with 202 teeth, and with the input shaft of said device driven at a speed of 2000 RPM, for printing a paper web 32.0 inches wide and having a thickness of 0.003 inch, with the web generally under 48 lbs. tension, the motor 107 is driven at 1936.560 RPM for an impression roll speed of 399.874 RPM. For printing a web of the same paper (same width) having a thickness of 0.006 inch, with the web generally under 96 lbs. tension, the motor 107 is driven at 1873.159 RPM for an impression roll speed of 399.749 RPM.

As various changes could be made in the above constructions without departing from the scope of the invention, it is intended that all matter contained in the above description or shown in the accompanying drawings shall be interpreted as illustrative and not in a limiting sense.

What is claimed is:

1. A flexographic printing press having an impression roll and a plate roll for mounting thereon a flexographic printing plate, wherein a web to be imprinted travels between said rolls for printing of impressions on the web by the plate roll, the web travelling around the impression roll, and the impression roll being rotary in one direction to feed the web forward at a rate of speed related to the impression roll diameter and the impression roll speed, and comprising means for driving the impression roll including means for adjusting the speed of the impression roll for feeding webs of different thickness forward one at a time with the web under tension and with the speed of the impression roll adjusted in accordance with the thickness and the tension on the web being fed forward to feed webs of different thickness at different speeds such that the impressions printed on the different webs are of substantially the same length when the printed webs are relieved of tension, wherein said means for adjusting the speed of the impression roll comprises a strain wave gear device comprising an input shaft and an output shaft with a drive from the output shaft to the impression roll, said driving means comprising a line shaft and a take-off drive from the line shaft directly connected to said input shaft for driving said input shaft, a toothed strain gear on the input shaft, a toothed ring gear on the output shaft in mesh with the strain gear, said ring gear and said strain gear having a different number of teeth, a wave generator rotary within the strain gear, and means comprising a motor adapted to drive the wave generator at a selected speed for driving the ring gear and the output shaft to drive the impression roll at the adjusted speed.

* * * * *